US007435333B2

(12) United States Patent
Varadaraj et al.

(10) Patent No.: US 7,435,333 B2
(45) Date of Patent: Oct. 14, 2008

(54) UPGRADING ASPHALTENE CONTAINING OILS

(75) Inventors: Ramesh Varadaraj, Flemington, NJ (US); Cornelius Hendrick Brons, Easton, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 658 days.

(21) Appl. No.: 11/157,554

(22) Filed: Jun. 21, 2005

(65) Prior Publication Data

US 2006/0000749 A1 Jan. 5, 2006

Related U.S. Application Data

(60) Provisional application No. 60/585,151, filed on Jul. 2, 2004.

(51) Int. Cl.
*C01G 31/00* (2006.01)
*C10C 3/00* (2006.01)

(52) U.S. Cl. ..... 208/177; 208/39; 208/370

(58) Field of Classification Search ..... 208/177, 208/39, 370

See application file for complete search history.

(56) References Cited

U.S. PATENT DOCUMENTS

| | | | | |
|---|---|---|---|---|
| 4,420,008 | A * | 12/1983 | Shu | 137/4 |
| 6,187,172 | B1 * | 2/2001 | Plummer | 208/44 |
| 6,402,934 | B1 * | 6/2002 | Chheda et al. | 208/44 |
| 7,037,724 | B2 * | 5/2006 | Stark et al. | 436/55 |
| 2002/0062860 | A1 * | 5/2002 | Stark et al. | 137/88 |
| 2005/0106738 | A1 * | 5/2005 | Stark et al. | 436/55 |

* cited by examiner

*Primary Examiner*—Glenn Caldarola
*Assistant Examiner*—John C Douglas
(74) *Attorney, Agent, or Firm*—Estelle C. Bakun; Gary P. Katz

(57) ABSTRACT

A method for reducing the viscosity and surface wetting tendency of an oil containing hydrophilic aspaltenes comprises adding to said oil an amount of hydrophobic asphaltenes in the range of 1 to 80 wt % based on weight of the hydrophilic asphaltense of said oil.

8 Claims, No Drawings

UPGRADING ASPHALTENE CONTAINING OILS

This application claims the benefit of U.S. Ser. No. 60/585,151 filed Jul. 2, 2004.

FIELD OF THE INVENTION

The present invention relates to upgrading asphaltene containing hydrocarbon oils.

BACKGROUND OF THE INVENTION

Heavy oils are generally referred to those oils with high viscosity or API gravity less than about 23. Crude oils and crude oil residuum derived from atmospheric or vacuum distillation of crude oil are examples of heavy oils. The origin of high viscosity in heavy oils has been attributed to high asphaltene content of the oils. Viscosity reduction of heavy oils is important in production, transportation and refining operations of crude oil. Transporters and refiners of heavy oils have developed different methods to reduce the viscosity of heavy oils to improve their pumpability. One method includes diluting the heavy oil with gas condensate or a low viscosity oil. Fouling of metal surfaces by asphaltene containing oils is also a problem in heavy oil refining and transportation. One method for mitigating metal surface fouling is the use of anti-fouling additives or blending with non-asphaltene containing oils. These methods of reducing viscosity and metal surface fouling tendency of heavy oils require the use of substantial amounts of low viscosity oils that are often expensive and difficult to readily obtain especially at locations where the heavy oils are produced. There is therefore a continuing need for new and improved methods for reducing viscosity and surface wetting tendency of heavy oils. The instant invention addresses this need.

SUMMARY OF THE INVENTION

One embodiment is a method for reducing the viscosity and surface wetting tendency of an oil containing hydrophilic asphaltenes comprising adding to said oil an amount of hydrophobic asphaltenes in the range of 1 to 80 wt % based on the weight of the hydrophilic asphaltenes of said oil.

DESCRIPTION OF THE INVENTION AND PREFERRED EMBODIMENTS

Asphaltenes are alkyl poly-aromatic compounds typically present in crude oils and crude oil residuum and are known to those in the art of crude oil composition analyses. Further, the asphaltenes typically contain nitrogen, sulfur and oxygen hetero-atoms in their chemical structure. The nitrogen, sulfur and oxygen atoms are typically present in a variety of functional groups. Some non-limiting examples of such functional groups are sulfides for sulfur, secondary and tertiary amines for nitrogen and ethers for oxygen.

Applicants have found that crude oil asphaltenes from different geographic sources and from similar geographic sources but different regions differ with respect to their surface amphiphilicity, that is, the property of being hydrophobic or hydrophilic to contact with water. The property of being hydrophobic or hydrophilic to contact with water is determined by a contact angle analyses between a substrate and water and is known to one of ordinary skill in the art of contact angle analyses. A contact angle value between 0° to about 90° is attributed to the substrate being hydrophilic to contact with water. A contact angle value between about 90° and 180° is attributed to the substrate being hydrophobic to contact with water.

Contact angle analyses were conducted on asphaltenes isolated from a variety of crude oils. The asphaltenes were isolated by the n-heptane deasphalting method using a n-heptane to oil ratio of 10:1. Results shown in Table-1 indicate that crude oil asphaltenes vary from being highly hydrophilic exhibiting a contact angle of 24° to highly hydrophobic exhibiting a contact angle of 178°. For example, asphaltenes derived from Hamaca, Cold Lake and Celtic crude oils are observed to be hydrophilic, whereas those derived from Hoosier, Tulare and Talco crude oils are observed to be hydrophobic. Hereinafter it is to be understood that the terms hydrophilicity, hydrophilic, hydrophobicity and hydrophobic are each with reference to contact with water. Thus, asphaltene hydrophilicity to contact with water can be stated as simply asphaltene hydrophilicity. Hydrophilic asphaltenes are to be understood as asphaltenes that are hydrophilic to contact with water and exhibit a contact angle value between 0° to about 90°. Hydrophobic asphaltenes are to be understood as asphaltenes that are hydrophobic to contact with water and exhibit a contact angle value between about 90° to about 180°.

When hydrophobic asphaltenes, such as hydrophobic asphaltenes in Tulare and Talco crude oils, are added to oils containing hydrophilic asphaltenes such as Cold Lake, Hamaca, Celtic crude oils surprising viscosity results are observed as shown in Table-2. As seen in the examples for Cold Lake—Tulare, Hamaca—Tulare, Hamaca—Talco, and Celtic—Tulare a viscosity reduction of 15 to 88% (expressed as "% difference" in Table-2) is observed. This viscosity reduction is significantly higher than the calculated viscosity (expressed as "calculated viscosity" in Table-2). The calculated viscosity is the viscosity calculated based on a linear combination calculation using the weight fraction and viscosity of the constituents ie., crude oil containing hydrophilic asphaltenes and crude oil containing hydrophobic asphaltenes. For example, if two crude oils, O1 with a viscosity V1 and O2 with a viscosity V2, are mixed at 50:50 wt % ratio then the calculated viscosity of the resultant mixture is 0.5 V1+0.5V2. The novel hydrophilic asphaltene-hydrophobic asphaltene interaction is responsible for the observed non-linear viscosity reduction effect. This effect is observed from temperatures in the range of 35 to 65C.

In another experiment hydrophobic Tulare asphaltenes were isolated from Tulare crude oil by the n-heptane deasphalting method known to one of ordinary skill in the art of solvent deasphalting. The isolated Tulare asphaltenes were added to Hamaca crude oil at a weight ratio of 15 wt % hydrophobic Tulare asphaltenes based on the weight of the hydrophilic Hamaca asphaltenes. The mixture of Hamaca crude oil and added hydrophobic Tulare asphaltenes were heated to 65° C. and mixed for 3 hours. The mixture was cooled to room temperature and then the viscosity of the mixture was determined at 65° C. The hydrophobic asphaltene additized Hamaca crude oil had a viscosity of 4000 cP. The untreated Hamaca crude oil had a viscosity of 8005 cP at 65° C. Thus, addition of hydrophobic asphaltenes reduced the viscosity of the Hamaca crude oil by 50%.

In the method of reduction of viscosity and surface wetting tendency of a heavy oil by adding a hydrophobic asphaltene it is preferred to first determine the hydophilicity of the asphaltenes of the heavy oil. The hydrophilicity can be determined by isolating the asphaltenes of the heavy oil by solvent deasphalting and conducting a contact angle measurement with water on the isolated asphaltenes. It is preferred to add hydrophobic asphaltenes to the heavy oil containing hydrophilic asphaltenes such that the difference in contact angle between the hydrophilic asphaltenes of the heavy oil and the added hydrophobic asphaltenes is greater than about 30°. As an illustration consider the addition of hydrophobic Tulare asphaltenes to Hamaca oil. The Hamaca oil contains hydrophilic asphaltenes that exhibit a contact angle of 27°. The Tulare asphaltenes exhibit a contact angle of 178°. The difference in contact angle between the Hamaca hydrophilic asphaltenes and the Tulare asphaltenes is 151° and the addition of the hydrophobic Tulare asphlatenes results in a 50% viscosity reduction of the Hamaca oil.

Hydrophobic asphaltenes of the instant invention can be obtained by extraction from a hydrophobic asphaltene containing oil (crude oil or crude oil residuum) by solvent deasphalting methods known to one of ordinary skill in the art of solvent deasphalting. Butane, propane, pentane, hexane and mixtures of these solvents can be used as solvents in the solvent deasphalting process. It is preferred to use an oil to solvent ratio of about 1:10 in the solvent deasphalting. The preferred amount of hydrophobic asphaltene to be added to the oil containing hydrophilic asphaltenes is in the range of 1 to 80 wt % based on the weight of the hydrophilic asphaltenes of the oil. The more preferred amount of hydrophobic asphaltene to be added to the oil containing hydrophilic asphaltenes is in the range of 1 to 50 wt % based on the weight of the hydrophilic asphaltenes of the oil.

The hydrophobic asphaltenes can be added as a solid or can be solubilized in a suitable solvent called a "carrier solvent" and the mixture of hydrophobic asphaltene and carrier solvent can be added to the oil containing hydrophilic asphaltenes requiring upgrading. Preferred carrier solvents include aromatic solvents such as toluene and xylene in which the hydrophobic asphaltenes are soluble. Mixtures of aromatic solvents and mixtures of aromatic, aliphatic and naphthenic solvents can be used. Crude oil distillates can also be used. Preferably the crude oil distillates are aromatic distillates. One example of such an aromatic distillate is light catalytic cycle oil obtained from fluid catalytic cracking of oils known to one of ordinary skill in the art of fluid catalytic cracking. Crude oils containing hydrophobic asphaltenes can also be used. Preferably the hydrophobic asphaltenes are in the range of 1 to 75 wt % in the carrier solvent.

Applicant have also observed that a mixture of hydrophilic and hydrophobic asphaltenes exhibits reduced wetting of surfaces compared to the hydrophilic asphaltenes by itself. Reduced surface wetting can result in reduced surface fouling. Preventing or reducing surface fouling of metal surfaces is important in refining process equipment and transfer lines that refine and transfer asphaltene containing heavy oils. Surface fouling due to oils containing asphaltenes is generally the surface being contaminated or coated with carbonaceous material due to asphaltenes phase separating from the asphaltene containing oils and wetting the surface.

The following non-limiting example illustrates the wetting character of the hydrophilic and hydrophobic asphaltenes and the influence of adding hydrophobic asphaltenes to hydrophilic asphaltenes. In a Hot Stage experiment about 10 milligrams of asphaltene solids were placed on a glass plate and heated to the softening or melting range of the asphaltene. A video camera was placed perpendicular to the surface and pictures of the asphaltene in melt/liquid state recorded. Three sets of asphaltenes were examined:

1. Hydrophobic asphaltenes : Hoosier, Tulare and Talco,
2. Hydrophilic asphaltenes : Hamaca, Cold Lake and Celtic, and
3. Hydrophilic-hydrophobic asphaltene mixtures; 90 wt % Hamaca asphaltene 10 wt % Tulare asphaltene mixture and 90% Hamaca+10% Cold lake asphaltenes.

Observations are reported in Table-3.

The hydrophobic asphaltenes Hoosier, Tulare and Talco assumed a distinct spherical shape with minimal wetting of the glass slide. The hydrophilic asphaltenes Hamaca, Cold Lake and Celtic assumed a flat shape and spread on the glass slide with extensive wetting of the glass surface. These observations are consistent with the water contact angle data reported in Table-1. The hydrophobic asphaltenes do not wet the hydrophilic glass slide surface and take on a spherical shape. The hydrophilic asphaltenes wet the glass surface and take on a flat shape. The 90 wt % Hamaca asphaltene 10 wt % Tulare asphaltene mixture exhibited a spherical shape with minimal surface wetting. The 90% Hamaca+10% Cold lake asphaltenes exhibited a flat shape with wetting similar to the Hamaca asphaltenes. The addition of hydrophobic asphaltenes to the hydrophilic asphaltenes alters the wetting character of the mixture. The mixture had reduced wetting compared to the Hamaca asphaltenes.

Experimental Methods and Procedures: Viscosity

Viscosity determinations were made using the Haake viscometer (model # CV 100). The viscometer uses a (ME-30) cone and plate method to measure the viscosity of the sample. It has a minimum shear rate range of 0.50 s-1 and a maximum shear rate range of 100 s-1.

Asphaltene Extraction

In a typical experiment asphaltenes were extracted from the crude oil using n-heptane as the solvent and using a 10:1 solvent to crude oil ratio. The oil and solvent were mixed at 25C for 48 hours and the n-heptane insoluble material, asphaltene, was filtered and air-dried.

Contact Angle Measurement

Contact angles were measured between solid asphaltene films and water. Perfect water wetting of the asphaltene film surface will result in a contact angle of 0 degrees. Increasing contact angles from 0 to 180 degrees indicate increased hydrophobic character of the film to contact with water. Isolated asphaltenes were cast as thin films on a glass slide surface. Using a VCA 2500XE Video Contact Angle Analyzer, contact angles were determined between the solid asphaltene film and water. Contact Angle results are given in Table-1 and expressed in units of degrees.

TABLE 1

| CRUDE OIL | LOCATION | % ASPHALTENES n-C7H16 insolubles | Contact Angle (degrees) |
|---|---|---|---|
| HAMACA | Venezuala | 16.3 | 27 |
| CELTIC | Canada | 11.2 | 24 |
| COLD LAKE | Canada | 21.2 | 38 |
| HOOSIER | Canada | 7.4 | 111 |
| TALCO | Texas | 9.1 | 139 |
| TULARE | California | 2.6 | 178 |

TABLE 2

| Sample | VISCOSITY (cP) @ 10 sec-1 | | | | | | | | |
|---|---|---|---|---|---|---|---|---|---|
| | 35 C. | | | 45 C. | | | 65 C. | | |
| ID | observed | calculated | % difference | observed | calculated | % difference | observed | calculated | % difference |
| Celtic Crude | 4669 | | | 1879 | | | 556 | | |
| Tulare Crude | 989 | | | 542 | | | 155 | | |
| Cold Lake Crude | 5950 | | | 2749 | | | 715 | | |
| Hamaca Crude | — | | | — | | | 8005 | | |
| Talco Crude | 168 | | | | | | 74 | | |
| Celtic/Tulare | | | | | | | | | |
| 50/50 Wt. % | 1896 | 2829 | 32.98 | 923 | 1210 | 23.72 | 308 | 355 | 13.24 |
| 75/25 Wt. % | 1932 | 3749 | 48.47 | 1322 | 1544 | 14.38 | 377 | 455 | 17.14 |
| Cold Lake/Celtic | | | | | | | | | |
| 50/50 Wt. % | 5816 | 5309 | −9.55 | 1891 | 2314 | 18.28 | 476 | 635 | 25.04 |
| 75/25 Wt. % | 5487 | 4989 | −9.98 | 1879 | 2096 | 10.35 | 527 | 596 | 11.58 |
| Cold Lake/Tulare | | | | | | | | | |
| 50/50 Wt. % | 2326 | 3469 | 32.95 | 980 | 1645 | 40.43 | 266 | 435 | 38.85 |
| 75/25 Wt. % | 3809 | 4709 | 19.11 | 1569 | 2197 | 28.58 | 447 | 575 | 22.26 |
| Hamaca/Tulare | | | | | | | | | |
| 50/50 Wt. % | 5337 | | | 2300 | | | 607 | 4080 | 85.12 |
| Hamaca/Celtic | | | | | | | | | |
| 50/50 Wt. % | | | | | | | 2474 | 4275 | 42.13 |
| Hamaca/Talco | | | | | | | | | |
| 50/50 Wt. % | | | | | | | 481 | 4039 | 88.09 |

TABLE 3

| ASPHELTENE | MELT RANGE (C.) | SHAPE OBSERVATION (melt asphaltene) |
|---|---|---|
| HAMACA (H) | 180-210 | Flat |
| COLD LAKE (CL) | 176-210 | Flat |
| CELTIC (CE) | 153-181 | Flat |
| HOOSIER (HO) | 178-216 | Spherical |
| TALCO (TA) | 165-182 | Spherical |
| TULARE (TU) | 110-156 | Spherical |
| H 90% + TU 10% | 180-200 | Spherical |
| H 90% + CL 10% | 180-200 | Flat |

What is claimed is:

1. A method for reducing the viscosity and surface wetting tendency of an oil containing hydrophilic asphaltenes comprising adding to said oil an amount of hydrophobic asphaltenes in the range of 1 to 80 wt % based on the weight of the hydrophilic asphaltenes of said oil.

2. The method of claim 1 further comprising determining the value in degrees of the contact with water for the hydrophilic asphaltenes of said oil and then adding said hydrophobic asphaltenes such that the difference in contact angle between the hydrophobic asphaltenes and the hydrophilic asphaltenes of the oil is greater than 30 degrees.

3. The method of claim 1 wherein said hydrophobic asphaltenes are obtained from solvent deasphalting of oils containing hydrophobic asphaltenes.

4. The method of claim 3 wherein said solvent is n-heptane.

5. The method of claim 1 wherein said surface is a metal surface.

6. The method of claim 1 wherein said hydrophobic asphaltenes are added to said oil with a carrier solvent.

7. The method of claim 6 wherein said carrier solvent is selected from the group consisting of aromatic solvents, crude oil distillates, crude oils and mixtures thereof.

8. The method of claim 6 wherein the hydrophobic asphaltenes are in the range of 1 to 75 wt % in the carrier solvent.

* * * * *